United States Patent [19]

Whitener

[11] Patent Number: 5,021,279

[45] Date of Patent: Jun. 4, 1991

[54] EDGE PROTECTOR WITH ENHANCED GRIPPING MEMBER

[76] Inventor: Gary Whitener, 7220 E. Somerset Blvd., Paramount, Calif. 90723-0437

[21] Appl. No.: 372,706

[22] Filed: Jun. 26, 1989

[51] Int. Cl.[5] ..... B32B 3/06; B32B 3/10

[52] U.S. Cl. ..... 428/100; 428/120; 248/345.1; 52/718.1; 52/716

[58] Field of Search ..... 428/100, 120, 31; 248/345.1; 52/716, 717.1, 718.1

[56] References Cited

U.S. PATENT DOCUMENTS 3,200,448 8/1965 Bright ..... 52/716

*Primary Examiner*—Alexander S. Thomas

*Attorney, Agent, or Firm*—Thomas I. Rozsa

[57] ABSTRACT

An edge protection apparatus wherein the principal improvement lies in the structure used to retain the edge molding within and onto the object whose surface is to be protected such that the retaining grip will be held firmly for an extended period of time and will not become loose over time which is the major problem with prior art embodiments. An edge-trim or molding which is inserted into a slot in the front or edge of an object such as a furniture item (for example a desk), and held therein by a transverse gripping member. The exposed protector member comprises a piece of flexible material, preferably in the cross-sectional form of a semi-circle or arcuate member having a generally flat lower surface and an arcuate upper surface which is exposed and serves to protect the object. Connected to the exposed protector member is a transverse gripping member which can be designed in any multiplicity of configurations but which has as its central component the concept of a metal member embedded in and extending away from the protector member to thereby form a generally "T" shaped configuration and further comprises at least one tooth member extending back toward the protector member, which tooth member becomes embedded within the material of the object to be protected such that any attempt to pull the gripping member out will be resisted with considerable force since the tooth is embedded in a direction opposite to the direction of removal.

30 Claims, 1 Drawing Sheet

Fig. 1.
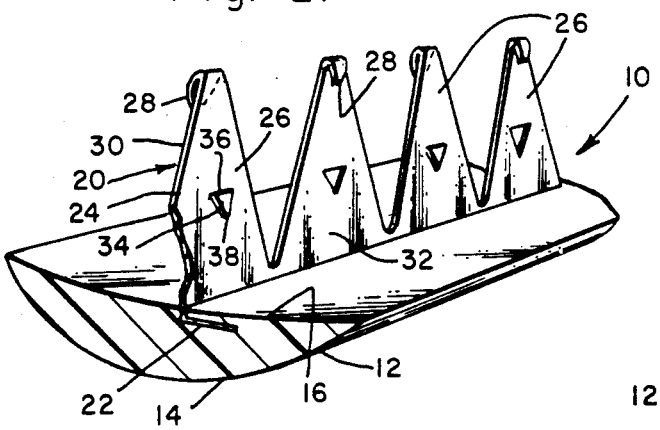
Fig. 2.
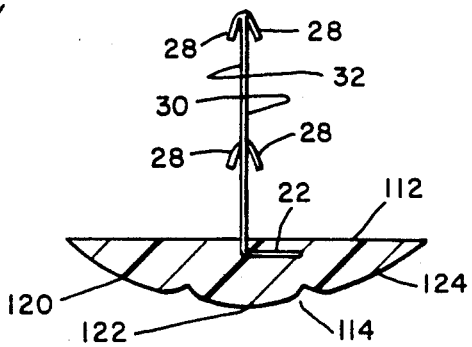
Fig. 3.
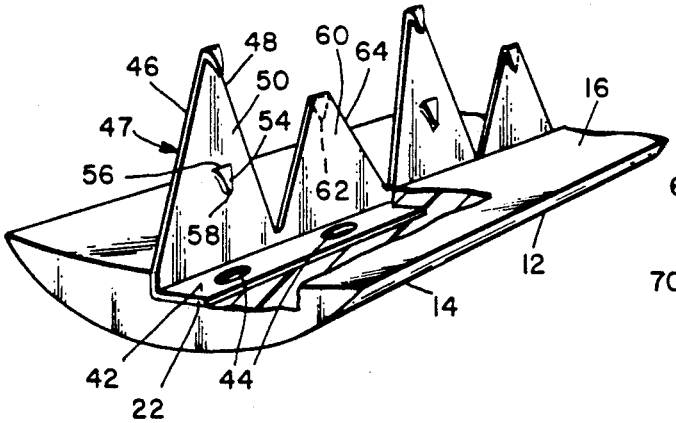
Fig. 4.
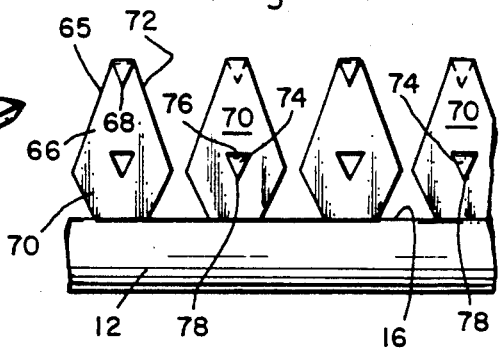
Fig. 5.
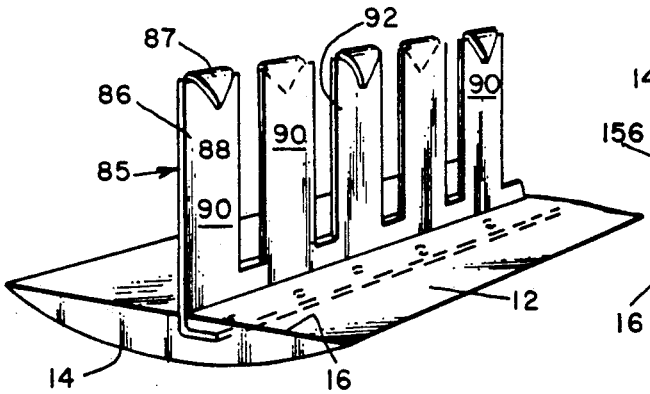
Fig. 6.
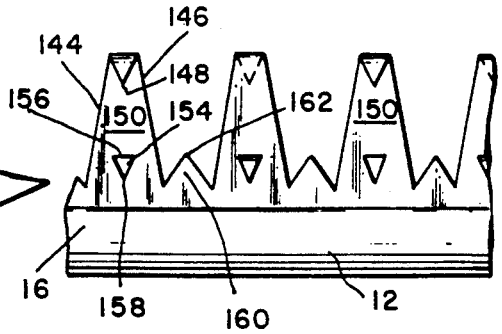
Fig. 8.
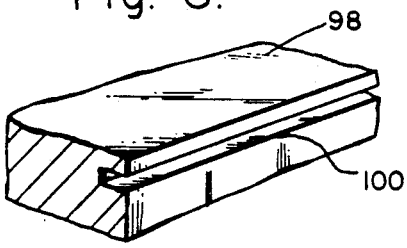
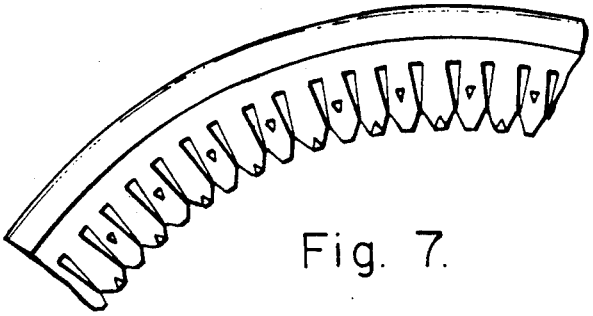
Fig. 7.

EDGE PROTECTOR WITH ENHANCED GRIPPING MEMBER

BACKGROUND OF THE INVENTION

1. FIELD OF THE INVENTION

The present invention relates to the field of edge trim and molding which serve as protector devices which are used to form a protective barrier around the edge of products such as articles of furniture including desks, cabinets, movable carts, etc. The present invention relates to the general area of flexible protecting edge trim which are affixed to the edge of articles such as furniture in a fixed manner to thereby protect the edge and the remainder of the furniture surface from being cut, scraped, nicked or otherwise defaced when another object is hit against it. The present invention further relates to the field of attaching apparatus which are used to attach the edge protector in a nonremovable manner to the article.

2. BACKGROUND OF THE INVENTION

In general, edge protection devices and in particular devices which are used to join one object to another are known in the prior art. The following patents are representative of the known prior art in this area:

1. U.S. Pat. No. 2,219,239 issued to Schaffert et al in 1940 for "strip Fastener For Window Glass".
2. U.S. Pat. No. 4,503,780 issued to Apissomian on Mar. 12, 1985 for "Table With Resilient Edge".
3. U.S. Pat. No. 4,109,981 issued to Pfaehler on Aug. 29, 1989 for "Cabinet-Like Furniture Unit Of Cellular Structure".
4. U.S. Pat. No. 3,115,108 issued to Craddock et al on Dec. 24, 1963 for "Table".
5. U.S. Pat. No. 2,569,532 issued to Marshall et al on Oct. 2, 1951 for "Joining Device".

U.S. Pat. No. 4,503,780 to Apissomian basically relates to a furniture construction item which includes an outer protective strip or edging 16. The edging is described in detail in Column 2, lines 62 through 68 and column 3, lines 1 through 26 and is substantially different from the present invention.

U.S. Pat. No. 4,109,981 issued to Pfaehler for "Cabinet-Like Furniture Unit Of Cellular Structure" is relevant for the protective T-shaped edge 16. Although not specifically called out, it appears that this edge protector 16 includes a central shaft of the T which has rib-like members that fit into an opening within the wall 9 or 10 (in FIGS. 2 and 3). However, the central T-shaped member with grippers thereon appears to be one single strip and is somewhat comparable to a well known piece of rubber material having a centralized rubber gripping member forming the central shaft of the T.

U.S. Pat. No. 3,115,108 issued to Craddock for a "Table" shows an edge protector or beading 27 which includes a transverse flange 28 (it is hard to see from the picture but the relevant text is in column 2 beginning on line 8). However, this design requires that the beading which includes the elongated continuous flange 28 should be affixed to the table by either cement or staples. Therefore, it does not have the gripping feature of the present invention.

U.S. Pat. No. 2,569,532 issued to Marshall for "Joining Device" does have transverse gripping members, but its function is to join two pieces of material such as wood at their corners by having the invention piece inserted at the corner with the transverse tangs or teeth 17 projecting into the material.

What is also known in the prior art is a piece of rubberized edge molding in the general shape of the "T", with the horizontal portion of the "T" being an arcuate rubberized piece which lies along the edge of the object to be protected and the shaft portion of the "T" being a serrated piece of rubber having grooves. The piece of molding is inserted into a slot in the furniture item by pushing or hammering the "T" molding such that the serrated shaft portion is squeezed into the slot and is retained therein by the serrated or grooved edges along the length of the shaft. A major problem with this prior art embodiment is that the serrated or grooved rubber shaft portion does not grip an object such as wood firmly and the rubberized molding frequently comes loose. This is also an apparent problem associated with each of the edge molding embodiments shown in the patents described above. While a rubberized molding which is retained through a rubber insert may initially hold firm, as the rubber ages and begins to harden, the gripping between the serrations or grooved edges of the rubber and the wood, plastic or other material into which it has been driven is loosened and the edge molding itself then comes loose and falls off the object. Therefore, a significant need exists for an improved edge protector configuration which will securely retain the edge molding within and on the object to be protected.

SUMMARY OF THE PRESENT INVENTION

The present invention relates to an improved edge protection apparatus wherein the principal improvement lies in the structure used to retain the edge molding within and onto the object whose surface is to be protected such that the retaining grip will be held firmly for an extended period of time and will not become loose over time which is the major problem with prior art embodiments.

The present invention relates to an edge-trim or molding which is inserted into a slot in the front or edge of an object such as a furniture item (for example a desk), and held therein by a transverse gripping member. The exposed protector member comprises a piece of flexible material, preferably in the cross-sectional form of a semi-cicle or arcuate member having a generally flat lower surface and an arcuate upper surface which is exposed and serves to protect the object. Connected to the exposed protector member is a transverse gripping member which can be designed in any multiplicity of configurations but which has as its central component the concept of a metal member embedded in and extending away from the protector member to thereby form a generally "T" shaped configuration and further comprises at least one tooth member extending back toward the protector member, which tooth member becomes embedded within the material of the object to be protected such that any attempt to pull the gripping member out will be resisted with considerable force since the tooth is embedded in a direction opposite to the direction of removal.

It has been discovered, according to the present invention, that if a flexible piece of material having an outer surface which is generally arcuate and an inner surface which conforms to the exterior shape of the object to be protected has embedded within it a metal insert which extends transversely to the flexible piece of material and further comprises at least one tooth which projects at an angle relative to the metal insert in a direction back toward the flexible piece of material, then the metal insert with the at least one tooth can be placed into a slot on the external surface of the object to be protected and the metal insert serves as a secure gripping member which is retained within the slot and serves to hold the flexible piece of material against the surface of the object adjacent the area of the slot.

It has also been discovered, according to the present invention, that if the metal insert comprises a multiplicity of triangular shaped metal spikes with the tip of the spike bent at an angle to the insert back toward the flexible piece of material, the gripping capacity of the insert is enhanced.

It has been further discovered, according to the present invention, that if the metal insert is comprised of a multiplicity of triangular shaped metal spikes with the tip of one spike bent at an angle to one face of the insert back toward the flexible piece of material and the tip of the adjacent spike being bent at angle to the opposite face of the adjacent spike and also back toward the flexible piece of material, then the gripping capacity of the insert is further enhanced. It has additionally been discovered that if the triangular shaped piece of metal further comprises an additional tooth along its surface bent at an angle to the surface of the metal and extending back toward the flexible piece of material, the gripping capacity of the insert is substantially enhanced. In addition, if the face along which the tooth located on the surface of the metal is at an angle to the opposite face to which the tip of the insert is bent, the gripping capacity is even further enhanced.

It has also been discovered, according to the present invention, that if the metal insert comprises a multiplicity of triangular shaped metal spikes with the tip of the spike bent at an angle to the insert back toward the flexible piece of material, and one insert has a pair of such teeth while the adjacent insert is shorter and has one tooth intermediate the height of the two teeth on the taller insert, the gripping capacity of the insert is enhanced.

It has further been discovered, according to the present invention, that the inserts do not have to be triangular and can in fact have any desired shape such as diamond shape or rectangular.

It is therefore an object of the present invention to provide a flexible protecting member which can be retained by a gripping member within the slot in the surface of an object such that the flexible protecting member abuts and protrudes from the surface of the object to thereby protect the object from being scratched or bruised by other objects striking the protecting member.

It is a further object of the present invention to provide an enhanced gripping or retaining member through the creation of backwardly extending teeth in the gripping member which extend at an angle to the surface of the gripping member and in the direction of the flexible protective material, to thereby create a gripping structure which grips within the object in a direction opposite to the direction of pull if the object is to be removed.

It is an additional object of the present invention to provide a multiplicity of configurations for an enhanced gripping member so that a given one of the configurations may be more suitable for a particular object.

Further novel features and other objects of the present invention will become apparent from the following detailed description, discussion, and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of one embodiment of the present invention protector member with enhanced retaining elements.

FIG. 2 is a side elevational view of a second alternative embodiment of the present invention protector member with enhanced retaining elements.

FIG. 3 is a perspective view of a third alternative embodiment of the present invention protector member with enhanced retaining elements.

FIG. 4 is a side elevational view of a fourth alternative embodiment of the present invention protector member with enhanced retaining elements.

FIG. 5 is a perspective view of a fifth alternative embodiment of the present invention protector member with enhanced retaining elements.

FIG. 6 is a side elevational view of a sixth alternative embodiment of the present invention protector member with enhanced retaining elements.

FIG. 7 is a side elevational view of a seventh alternative embodiment of the present invention protector member with enhanced retaining elements.

FIG. 8 is a perspective view of a portion of a surface of an object with a slot therein to accommodate the present invention protector member.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring first to FIG. 8, there is shown at 98 the edge of an object such as a piece of furniture. For example, the edge 98 can be the edge of a desk or a cart. Chiseled or molded into the edge 98 is a transverse slot 100 which is designed to accommodate the gripping member of a conventional edge protector and which will be used to accommodate the gripping member of the present invention edge protector with enhanced gripping member. The gripping member is embedded within the slot 100 by hammering against the face of the protector member or pushing the gripping member into the slot, depending upon the type of material from which the edge is constructed. Most commonly, the edge 98 and object will be made of wood but other materials such as plastic and molded polyvinyl are also materials for object edges 98 with which the present invention can be used.

The essential concept of the present invention edge protector is illustrated in FIG. 1. FIG. 1 is a perspective view of one embodiment of the present invention edge protector 10. The edge protector comprises two essential component parts. The first part is the edge protector member or shield 12. In cross-sectional view, the most common configuration of the edge protector member 12 is an arcuate outer surface 14 and a generally flat or slightly curved transverse inner surface 16. The outer surface 14 is usually arcuate in order to provide an attractive cosmetic rounded appearance when the edge protector 10 is embedded into the edge of the object 98 which it serves to protect. It will be appreciated that configurations other than arcuate are also within the spirit and scope of the present invention. The transverse inner surface 16 is designed to conform to the exterior shape of the edge 98 to which the edge protector 10 will be embedded. Since most edges of items such as desks, cabinets, carts, etc. are flat, the inner surface 16 si also flat. However, it will be appreciated that the intent to to have a mating fit such that the edge protector 10 will lie flush against the edge 98 after the edge protector 10 is embedded in slot 100. Therefore, if the surface of edge 98 is slightly arcuate or some other shape, the transverse inner surface 16 will be molded to conform to this arcuate or other shape. The edge protector member 12 is made out of flexible material, which by way of example can be rubber, silicone, polyvinyl, mylar or some other desirable material. The edge protector member 12 is preferably extruded into the desired shape.

The second essential element of the present invention edge protector is the gripping member 20. In all of the embodiments of the present invention, the gripping member comprises a transverse base 22 which is embedded in the edge protector member 12. Preferably, the transverse base 22 of the gripping member 20 is embedded into the edge protector member 12 while the edge protector member 12 is being extruded so that the transverse base 22 is deeply embedded into the body of the edge protector member 12 and cannot be pulled out. In order to facilitate the strength of the embedding, the transverse base member 22 is preferably aligned generally parallel to the transverse inner surface 16 of the edge protector member 12 so that the full depth of edge protector material between the transverse base 22 and the transverse inner surface 16 serves as a retaining member to keep the transverse base 22 embedded within the edge protector member.

Integral with and extending transversely to the transverse base member 22 is the insert gripping member 24. Preferably, the insert gripping member 24 is approximately at 90 degrees to the transverse base member and therefore at approximately 90 degrees to the transverse inner surface 16, to thereby form a generally "T" shaped configuration for the edge protector 10. However, for various applications, it may be preferable that the insert gripping member 24 extend at an angle other than 90 degrees to the transverse inner surface 16 and therefore it will be appreciated that the insert gripping member 24 can be set at various angles from approximately 1 degree to approximately 89 degrees relative to the transverse inner surface 16 and also relative to the transverse base 16.

The various configurations for the insert gripping member 24 make up the variations in the embodiments of the present invention edge protector with enhanced gripping member. The first embodiment is illustrated in FIG. 1. The insert gripping member comprises a multiplicity of generally triangular shaped structures 26 which extend transversely to the transverse inner surface 16 of the edge protector member 12. The tip 28 of the triangular structure 26 is bent at an angle relative to one surface 30 of the triangular shaped structure 26 such that tip 28 points backward in the general direction of the transverse inner surface 16 to thereby form a tooth projecting from the tip of the triangular structure 26. In one variation, the tip of one triangular structure 26 is bent in the direction of one side or surface 30 and in the adjacent triangular structure 26 the tip 28 is bent in the direction of the opposite side 32 of the triangular structure. The sequence is alternated along the length of the insert gripping member 24 as illustrated in FIG. 1. To add additional gripping power, a second tooth structure is formed within the surface of the triangular structure 26. A portion of material 34 in the shape of a tooth or triangle is punched or stamped out of the triangular structure 26 such that it remains affixed to the triangular surface 26 along a base line 36 while its two triangular edges and its tip 38 protrude at an angle to the surface of the triangular structure and such that the tip 38 points toward the transverse inner surface 16 of edge protector member 12. In the preferred embodiment, the tip 28 of the triangular structure 26 is to one side or surface (for example 30) of the triangular structure 26, and the middle tooth 34 is punched out such that it is at an angle relative to the opposite side (for example 32) of the triangular structure. This sequence is alternated along the length of the insert gripping member 24 as illustrated in FIG. 1.

An alternative embodiment to the insert gripping member is illustrated in FIG. 3. The alternative embodiment transverse base 42 further comprises a multiplicity of spaced apart openings 44 spaced along the length of the base. This is different from the first transverse base 22 which is a solid piece of metal. The purpose of the openings 42 is facilitate bending of the transverse base 42. While transverse base 22 can be bent into an arcuate shape to be molded around corners of the edge 98 which the edge protector is protecting, the openings 44 provide a gap in the base 42 which make it easier to bend. It will be appreciated that the type of base 42 illustrated in FIG. 3 may also be used with the embodiment of insert gripping member illustrated in FIG. 1 or other insert gripping members to be described. As with the transverse base 22, preferably, the transverse base 42 is embedded into the edge protector member 12 while the edge protector member 12 is being molded and before the flexible material of the edge protector member 12 has cured so that the transverse base 42 is deeply embedded into the body of the edge protector member 12 and cannot be pulled out. In order to facilitate the strength of the embedding, the transverse base member 42 is preferably aligned generally parallel to the transverse inner surface 16 of the edge protector member 12 so that the full depth of edge protector material between the transverse base 42 and the transverse inner surface 16 serves as a retaining member to keep the transverse base 42 embedded within the edge protector member. Integral with and extending transversely to the transverse base member 42 is the alternative embodiment insert gripping member 47.

The alternative embodiment insert gripping member 47 comprises a multiplicity of generally triangular shaped structures having two different heights, each of which extend transversely to the transverse inner surface 16 of the edge protector member 12. One generally triangular structure 46 has a tip 48 which is bent at an angle relative to one surface 50 of the triangular shaped structure 46 such that tip 48 points backward in the general direction of the transverse inner surface 16 to thereby form a tooth projecting from the tip of the triangular structure 46. To add additional gripping power, a second tooth structure is formed within the surface of the triangular structure 46. A portion of material 54 in the shape of a tooth or triangle is punched or stamped out of the triangular structure 46 such that it remains affixed to the triangular structure 46 along a base line 56 while its two triangular edges and its tip 58 protrude at an angle to the surface of the triangular structure 46 and such that the tip 58 points toward the transverse inner surface 16 of edge protector member 12. In the embodiment shown in FIG. 3, the tip 58 and the triangular portion of material 54 are on the same side of the triangular shaped structure 46. It is also within the spirit and scope of the present invention for them to be on alternative sides of the structure as illustrated in FIG. 1. Adjacent the first triangular structure 46 is a second triangular structure 60 which has a height approximately mid-way between the height of the first triangular structure 46 and the punched out section 54. The tip 62 of triangular structure 60 is bent at an angle to surface 64 of triangular structure 60 such that the tip points toward the transverse inner surface 16 of edge protector member 12. Therefore the tip 64 of lower triangular structure 60 is on the opposite side of the triangular structure relative to the tip 48 of triangular structure 46. It will be appreciated that the tip 62 could also be on the same side of triangular structure 60 as tip 48 is relative to triangular structure 46. The sequence is alternated along the length of the insert gripping member 42 as illustrated in FIG. 3 with alternative larger triangular structure 46 having two or more teeth and smaller triangular structure 60 having one or more teeth.

A third alternative embodiment of the insert gripping member is illustrated in FIG. 4. The insert gripping member 65 comprises a multiplicity of truncated generally diamond-shaped structures 66 which extend transversely to the transverse inner surface 16 of the edge protector member 12. The tip 68 of the truncated generally diamond shaped structure 66 is bent at an angle relative to one surface 70 of the structure 66 such that tip 68 points downward in the general direction of the transverse inner surface 16 to thereby form a tooth projecting from the tip of the structure 66. In one variation, the tip of one truncated generally diamond shaped structure 66 is bent in the direction of one side or surface 70 and in the adjacent truncated generally diamond shaped structure 66 the tip 68 is bent in the direction of the opposite side 72 of the structure. The sequence is alternated along the length of the insert gripping member 65 as illustrated in FIG. 4. To add additional gripping power, a second tooth structure is formed within the surface of the truncated generally diamond shaped structure 66. A portion of material 74 in the shape of a tooth or triangle is punched or stamped out of the structure 66 such that it remains affixed to the surface 70 along a base line 76 while its two triangular edges and its tip 78 protrude at an angle to the surface of the triangular structure and such that the tip 78 points toward the transverse inner surface 16 of edge protector member 12. In the preferred embodiment, the tip 78 of the truncated generally diamond shaped structure 76 is to one side or surface (for example 70) of the triangular structure 66, and the middle tooth 74 is punched out such that it is at an angle relative to the opposite side (for example 72) of the triangular structure. This sequence is alternated along the length of the insert gripping member 65 as illustrated in FIG. 5.

In the embodiments of FIGS. 1, 3 and 4, the insert structure has been shown as a triangle or truncated diamond. It is also possible for the inserts to be generally rectangular, as illustrated in the embodiment of FIG. 5. The insert gripping member 85 comprises a multiplicity of rectangular shaped structures 86 which extend transversely to the transverse inner surface 16 of the edge protector member 12. At the top, the structure is bent downward and the end portion 87 is in the shape of a triangle or tooth such that it is bent at an angle relative to one surface 90 of the structure 86 such that tip 88 points downward in the general direction of the transverse inner surface 16 to thereby form a tooth projecting from the top of the structure 86. In one variation, the triangular top 87 and tip 88 of one rectangular shaped structure 86 is bent in the direction of one side or surface 90 and in the adjacent rectangular shaped structure 86 the triangular top 87 and tip 88 is bent in the direction of the opposite side 92 of the structure. The sequence is alternated along the length of the insert gripping member 85 as illustrated in FIG. 4. Although not illustrated, it is also possible to add to the gripping power by having a second tooth punched out of the rectangular structure 86 in the manner illustrated in the embodiments of FIGS. 1, 3 and 4.

Another alternative embodiment to the insert gripping member is illustrated in FIG. 6. The alternative embodiment insert gripping member 144 comprises a multiplicity of generally triangular shaped structures having two different heights, each of which extend transversely to the transverse inner surface 16 of the edge protector member 12. One generally triangular structure 146 has a tip 148 which is bent at an angle relative to one surface 150 of the triangular shaped structure 146 such that tip 148 points backward in the general direction of the transverse inner surface 16 to thereby form a tooth projecting from the tip of the triangular structure 146. To add additional gripping power, a second tooth structure is formed within the surface of the triangular structure 146. A portion of material 154 in the shape of a tooth or triangle is punched or stamped out of the triangular structure 146 such that it remains affixed to the triangular structure 146 along a base line 156 while its two triangular edges and its tip 158 protrude at an angle to the surface of the triangular structure 146 and such that the tip 158 points toward the transverse inner surface 16 of edge protector member 12. In the embodiment shown in FIG. 6, the tip 148 and the triangular portion of material 154 are on opposite sides of the triangular shaped structure 146. It is also within the spirit and scope of the present invention for them to be on the same side of the structure as illustrated in FIG. 3. Adjacent the first triangular structure 46 is a second triangular structure 160 which has a height that is much smaller than the first triangular structure 146 and which does not have a backwardly directed tooth. Instead, the tip 162 of this structure points away from the transverse inner surface 16 of the triangular shaped structure. The sequence is alternated along the length of the insert gripping member 144 as illustrated in FIG. 6 with alternative larger triangular structures 146 having two teeth and smaller triangular structure 160 having no teeth.

In the embodiments of FIGS. 1, 3, 4, 5, and 6, the edge protector member or shield 12 was essentially the same. It is certainly within the spirit and scope of the present invention for the edge protector 12 to have a different shape. One alternative shape for edge protector member 112 is illustrated in FIG. 2. The outer surface 114 is formed in three separate arcuate sections, a first arcuate section 120, a middle or second arcuate section 122 and a third arcuate section 124. First and third arcuate sections 120 and 124 are symmetrical. The transverse inner surface 112 is generally flat. It will be appreciated that this is just one of many possible alternative embodiments for the edge protector member. The edge protector member can be made of any suitable material which is preferably flexible material such as rubber, mylar, or a plastic derivative.

In general, the insert gripping member including the transverse base and gripping portion in any of the alternative embodiments can be made of any suitable material. Metal such as steel, tin, aluminum, titanium or other strong metals are the preferred material for the insert gripping member when the edge 98 into which it will be placed is made of wood. Various strong plastics such as mylar, polyvinyl chloride, silicon and other such materials can also be used when the edge surface 98 is made of a comparable plastic material. It is emphasized that it is the design concept with backwardly gripping teeth that is the essential feature of the insert gripping portion of the present invention edge protector and any suitable material can be used depending upon the specific application and material of edge which the present invention edge protector is being used to protect. FIG. 7 illustrates the present invention edge protector formed into an arcuate piece. Any of the embodiments illustrated in FIGS. 1 through 6 can be formed into a similar arcuate piece so that the present invention edge protector can be used to be formed around an arcuate member.

In application, the insert gripping members are hammered or pushed into the slot 100 in the edge 98 to be protected such that the inner transverse surface 16 of the edge protector member lies flush against the surface 98. The key concept of the present invention is that the backward or downwardly pointing teeth, regardless of the configuration, become embedded into the material of the structure and are aligned in a direction opposite to the direction of removal or direction of pulling in order to remove the edge protector and therefore enable the edge protector to remain firmly embedded in the structure.

Defined more broadly, the present invention is an edge protector, comprising: (a) an edge protector member having an outer surface and a transverse inner surface defining the body of the edge protector member; (b) a gripping member further comprising a transverse base and a insert gripping member; (c) said transverse base of said gripping member embedded within the body of said edge protector; (d) said insert gripping member protruding from the transverse inner surface of said edge protector and extending at an angle relative to said transverse inner surface; and (e) said insert gripping member further comprising a multiplicity aligned gripping pieces each extending at an angle relative to said transverse inner surface of said edge protector member, said gripping pieces having a pair of lateral faces, and at least some of said gripping pieces having at least one tooth bent at an angle relative to a lateral face of its gripping piece such that the tip of the tooth points in the general direction of the transverse inner surface of the edge protector member.

The present invention can also be defined as an edge protector, comprising: (a) an edge protector member having an outer surface and a transverse inner surface defining the body of the edge protector member; (b) a gripping member further comprising a transverse base and a insert gripping member; (c) said transverse base of said gripping member embedded within the body of said edge protector; (d) said insert gripping member protruding from the transverse inner surface of said edge protector and extending at an angle relative to said transverse inner surface; and (e) said insert gripping member further comprising a multiplicity of generally triangular shaped structures aligned along the length of said insert gripping member, each triangular shaped structure extending at an angle relative to said transverse inner surface of said edge protector member, the triangular shaped structures having a pair of lateral faces and the tip of each of said triangular shaped structures bent at an angle relative to one lateral face of the triangular shaped structure such that its tip points in the general direction of the transverse inner surface of the edge protector member. The insert gripping member can also have a multiplicity of generally rectangular shapes structures or generally truncated diamond shaped structures.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An edge protector, comprising:

a. an edge protector member having an outer surface and a transverse inner surface defining the body of the edge protector member;

b. a gripping member further comprising a transverse base and a insert gripping member;

c. said transverse base of said gripping member embedded within the body of said edge protector;

d. said insert gripping member protruding from the transverse inner surface of said edge protector and extending at an angle relative to said transverse inner surface; and e. said insert gripping member further comprising a multiplicity of generally triangular shaped structures aligned along the length of said insert gripping member, each triangular shaped structure extending at an angle relative to said transverse inner surface of said edge protector member, the triangular shaped structures having a pair of lateral faces and the tip of each of said triangular shaped structures bent at an angle relative to one lateral face of the triangular shaped structure such that its tip points in the general direction of the transverse inner surface of the edge protector member.

2. An edge protector in accordance with claim 1 wherein a triangular shaped tooth extends from one lateral face of each triangular shaped structure and extends at an angle relative to the lateral face of the triangular shaped structure, with the tip of the tooth pointing in the general direction of the transverse inner surface of the edge protector member.

3. An edge protector in accordance in claim 2 wherein for each triangular shaped structure, the tip of the triangular shaped structure is bent at an angle relative to one lateral face of the triangular shaped structure and the triangular shaped tooth extending from a lateral face is at an angle relative to the opposite face of the triangular shaped structure.

4. An edge protector in accordance in claim 2 wherein for each triangular shaped structure, the tip of the triangular shaped structure is bent at an angle relative to one lateral face of the triangular shaped structure and the triangular shaped tooth extending from a lateral face is at an angle relative to the same face of the triangular shaped structure.

5. An edge protector in accordance with claim 1 wherein the tip of one triangular shaped structure is bent at an angle relative to one lateral face of the triangular shaped structure and the tip of the adjacent triangular shaped structure is bent at an angle relative to the opposite lateral face of its triangular shaped structure and the sequence of alternating sides relative to which the tip of the triangular shaped structure is bent continues on respective triangular shaped structures along the length of the insert gripping member.

6. An edge protector in accordance with claim 5 wherein a triangular shaped tooth extends from one lateral face of each triangular shaped structure and extends at an angle relative to the lateral face of the triangular shaped structure, with the tip of the tooth pointing in the general direction of the transverse inner surface of the edge protector member 7. An edge protector in accordance in claim 6 wherein for each triangular shaped structure, the tip of the triangular shaped structure is bent at an angle relative to one lateral face of the triangular shaped structure and the triangular shaped tooth extending from a lateral face is at an angle relative to the opposite face of the triangular shaped structure.

8. An edge protector in accordance in claim 6 wherein for each triangular shaped structure, the tip of the triangular shaped structure is bent at an angle relative to one lateral face of the triangular shaped structure and the triangular shaped tooth extending from a lateral face is at an angle relative to the same face of the triangular shaped structure.

9. An edge protector in accordance with claim 1 wherein the angle between the triangular shaped structures of the insert gripping member and transverse inner surface of said edge protector member is approximately 90 degrees.

10. An edge protector in accordance with claim 1 wherein said edge protector member is made of flexible material and said insert gripping member including said transverse base and said multiplicity of triangular shaped structures is made of metal.

11. An edge protector, comprising:

a. an edge protector member having an outer surface and a transverse inner surface defining the body of the edge protector member;

b. a gripping member further comprising a transverse base and a insert gripping member;

c. said transverse base of said gripping member embedded within the body of said edge protector;

d. said insert gripping member protruding from the transverse inner surface of said edge protector and extending at an angle relative to said transverse inner surface; and e. said insert gripping member further comprising a multiplicity of truncated generally diamond shaped structures aligned along the length of said insert gripping member, each truncated generally diamond shaped structure extending at an angle relative to said transverse inner surface of said edge protector member, the truncated generally diamond shaped structures having a pair of lateral faces and the tip of each of said truncated generally diamond shaped structures bent at an angle relative to one lateral face of the truncated generally diamond shaped structure such that its tip points in the general direction of the transverse inner surface of the edge protector member.

12. An edge protector in accordance with claim 11 wherein a triangular shaped tooth extends from one lateral face of each truncated generally diamond shaped structure and extends at an angle relative to the lateral face of the truncated generally diamond shaped structure, with the tip of the tooth pointing in the general direction of the transverse inner surface of the edge protector member.

13. An edge protector in accordance in claim 12 wherein for each truncated generally diamond shaped structure, the tip of the truncated generally diamond shaped structure is bent at an angle relative to one lateral face of the truncated generally diamond shaped structure and the triangular shaped tooth extending from a lateral face is at an angle relative to the opposite face of the truncated generally diamond shaped structure.

14. An edge protector in accordance in claim 12 wherein for each truncated generally diamond shaped structure, the tip of the truncated generally diamond shaped structure is bent at an angle relative to one lateral face of the truncated generally diamond shaped structure and the triangular shaped tooth extending from a lateral face is at an angle relative to the same face of the truncated generally diamond shaped structure.

15. An edge protector in accordance with claim 11 wherein the tip of one truncated generally diamond shaped structure is bent at an angle relative to one lateral face of the truncated generally diamond shaped structure and the tip of the adjacent truncated generally diamond shaped structure is bent at an angle relative to the opposite lateral face of its truncated generally diamond shaped structure structure and the sequence of alternating sides relative to which the tip of the truncated generally diamond shaped structure is bent continues on respective truncated generally diamond shaped structures along the length of the insert gripping member.

16. An edge protector in accordance with claim 15 wherein a triangular shaped tooth extends from one lateral face of each truncated generally diamond shaped structure and extends at an angle relative to the lateral face of the truncated generally diamond shaped structure, with the tip of the tooth pointing in the general direction of the transverse inner surface of the edge protector member.

17. An edge protector in accordance in claim 16 wherein for each truncated generally diamond shaped structure, the tip of the truncated generally diamond shaped structure is bent at an angle relative to one lateral face of the truncated generally diamond shaped structure and the triangular shaped tooth extending from a lateral face is at an angle relative to the opposite face of the truncated generally diamond shaped structure.

18. An edge protector in accordance in claim 16 wherein for each truncated generally diamond shaped structure, the tip of the truncated generally diamond shaped structure is bent at an angle relative to one lateral face of the truncated generally diamond shaped structure and the triangular shaped tooth extending from a lateral face is at an angle relative to the same face of the truncated generally diamond shaped structure.

19. An edge protector in accordance with claim 11 wherein the angle between the truncated generally diamond shaped structures of the insert gripping member and transverse inner surface of said edge protector member is approximately 90 degrees.

20. An edge protector in accordance with claim 11 wherein said edge protector member is made of flexible material and said insert gripping member including said transverse base and said multiplicity of generally truncated diamond shaped structures is made of metal.

21. An edge protector, comprising:

a. an edge protector member having an outer surface and a transverse inner surface defining the body of the edge protector member;

b a gripping member further comprising a transverse base and a insert gripping member;

c. said transverse base of said gripping member embedded within the body of said edge protector;

d. said insert gripping member protruding from the transverse inner surface of said edge protector and extending at an angle relative to said transverse inner surface; and e. said insert gripping member further comprising a multiplicity of generally rectangular shaped structures having a pointed tip aligned along the length of said insert gripping member, each rectangular shaped structure extending at an angle relative to said transverse inner surface of said edge protector member, the rectangular shaped structures having a pair of lateral faces and the tip of each of said rectangular shaped structures bent at an angle relative to one lateral face of the rectangular shaped structure such that its tip points in the general direction of the transverse inner surface of the edge protector member.

22. An edge protector in accordance with claim 21 wherein a triangular shaped tooth extends from one lateral face of each rectangular shaped structure and extends at an angle relative to the lateral face of the rectangular shaped structure, with the tip of the tooth pointing in the general direction of the transverse inner surface of the edge protector member.

23. An edge protector in accordance in claim 22 wherein for each rectangular shaped structure, the tip of the rectangular shaped structure is bent at an angle relative to one lateral face of the rectangular shaped structure and the rectangular shaped tooth extending from a lateral face is at an angle relative to the opposite face of the rectangular shaped structure.

24. An edge protector in accordance in claim 22 wherein for each rectangular shaped structure, the tip of the rectangular shaped structure is bent at an angle relative to one lateral face of the rectangular shaped structure and the rectangular shaped tooth extending from a lateral face is at an angle relative to the same face of the rectangular shaped structure.

25. An edge protector in accordance with claim 21 wherein the tip of one rectangular shaped structure is bent at an angle relative to one lateral face of the rectangular shaped structure and the tip of the adjacent rectangular shaped structure is bent at an angle relative to the opposite lateral face of its rectangular shaped structure and the sequence of alternating sides relative to which the tip of the rectangular shaped structure is bent continues on respective rectangular shaped structures along the length of the insert gripping member.

26. An edge protector in accordance with claim 25 wherein a triangular shaped tooth extends from one lateral face of each rectangular shaped structure and extends at an angle relative to the lateral face of the triangular shaped structure, with the tip of the tooth pointing in the general direction of the transverse inner surface of the edge protector member.

27. An edge protector in accordance in claim 26 wherein for each rectangular shaped structure, the tip of the rectangular shaped structure is bent at an angle relative to one lateral face of the rectangular shaped structure and the triangular shaped tooth extending from a lateral face is at an angle relative to the opposite face of the rectangular shaped structure.

28. An edge protector in accordance in claim 26 wherein for each rectangular shaped structure, the tip of the rectangular shaped structure is bent at an angle relative to one lateral face of the rectangular shaped structure and the rectangular shaped tooth extending from a lateral face is at an angle relative to the same face of the rectangular shaped structure.

29. An edge protector in accordance with claim 21 wherein the angle between the rectangular shaped structures of the insert gripping member and transverse inner surface of said edge protector member is approximately 90 degrees.

30. An edge protector in accordance with claim 21 wherein said edge protector member is made of flexible material and said insert gripping member including said transverse base and said multiplicity of generally rectangular shaped structures is made of metal.

* * * * *